US011377284B2

(12) United States Patent
Bogdanov et al.

(10) Patent No.: US 11,377,284 B2
(45) Date of Patent: Jul. 5, 2022

(54) RESEALABLE BAG AND METHOD OF PRODUCING THE RESEALABLE BAG

(71) Applicant: General Mills, Inc., Minneapolis, MN (US)

(72) Inventors: Emil Bogdanov, Excelsior, MN (US); Mychal Barrett Brosch, Chanhassen, MN (US)

(73) Assignee: General Mills, Inc., Minneapolis, MN (US)

( * ) Notice: Subject to any disclaimer, the term of this patent is extended or adjusted under 35 U.S.C. 154(b) by 239 days.

(21) Appl. No.: 16/682,055

(22) Filed: Nov. 13, 2019

(65) Prior Publication Data

US 2021/0139217 A1 May 13, 2021

(51) Int. Cl.
*B65D 75/58* (2006.01)

(52) U.S. Cl.
CPC ..... *B65D 75/5811* (2013.01); *B65D 75/5866* (2013.01); *B65D 2575/586* (2013.01)

(58) Field of Classification Search
CPC ..... B65D 75/5811; B65D 75/5866; B65D 75/5855
USPC ..... 383/61.2, 906, 63
See application file for complete search history.

(56) References Cited

U.S. PATENT DOCUMENTS 4,759,642 A 7/1988 Van Erden et al.
4,925,316 A 5/1990 Van Erden et al.
5,174,658 A * 12/1992 Cook ..... B65D 33/007 150/900
5,435,864 A 7/1995 Machacek et al.
5,782,733 A 7/1998 Yeager
5,941,643 A 8/1999 Linkiewicz
5,972,396 A * 10/1999 Jurgovan ..... B65D 33/2533 426/106
6,971,794 B2 12/2005 Yeager
6,988,828 B2 * 1/2006 Linneweil ..... B65D 31/10 383/120
7,097,092 B1 * 8/2006 Marrale ..... B65D 5/5405 229/231
8,182,407 B2 5/2012 Yeager
9,315,299 B2 4/2016 Yeager
(Continued)

FOREIGN PATENT DOCUMENTS

CA 1271455 7/1990
EP 1783059 5/2007
WO WO 2016/012931 1/2016

*Primary Examiner* — Jes F Pascua
(74) *Attorney, Agent, or Firm* — Diederiks & Whitelaw, PLC; John L. Crimmins, Esq.

(57) ABSTRACT

A resealable bag includes a first end, a second end, a first transverse seal sealing the first end and a second transverse seal sealing the second end. The second transverse seal is part of a weak seal zone of the bag that can be readily unsealed by a consumer by hand. The bag further includes a third transverse seal between the first transverse seal and the second transverse seal, closer to the second transverse seal than the first transverse seal. The third transverse seal is at least partially longitudinally aligned with the second transverse seal and can be selectively unsealed and resealed by the consumer by hand. In one embodiment, a fourth transverse seal is located between the first transverse seal and the second transverse seal, while being at least partially transversely aligned with the third transverse seal, and part of a strong seal zone of the bag.

32 Claims, 5 Drawing Sheets

(56) References Cited

U.S. PATENT DOCUMENTS

| | | | | |
|---|---|---|---|---|
| 2004/0208400 | A1* | 10/2004 | Linneweil | B65D 75/5816 383/68 |
| 2007/0230834 | A1* | 10/2007 | Schneider | B65D 75/5805 383/64 |
| 2015/0251831 | A1 | 9/2015 | Steele | |
| 2016/0023809 | A1* | 1/2016 | Leeker | B65D 33/18 493/227 |
| 2016/0137378 | A1* | 5/2016 | Kruse | B31B 70/00 383/25 |
| 2017/0334608 | A1* | 11/2017 | Kruse | B65D 75/008 |
| 2018/0170644 | A1 | 6/2018 | Beer | |

* cited by examiner

RESEALABLE BAG AND METHOD OF PRODUCING THE RESEALABLE BAG

BACKGROUND OF THE INVENTION

The present invention pertains to the art of food production and, more particularly, to packaging for food products.

Food products are often packaged prior to sale. Such packaging can take the form of cans, jars, boxes or bags, for example. In the case of a ready-to-eat ("RTE") or breakfast cereal, the cereal is commonly packaged in a bag, with the bag optionally being contained within a box. Other food products, such as pet food and crackers, can also be packaged in bags, with or without the use of boxes. When a box is used, the box helps protect the food product during transportation and storage and provides convenient surfaces for marketing and nutritional information.

The bags are sealed during production to help keep the food products fresh. However, such bags typically have at least one seal that is meant to be torn, cut or peeled open to form a hole through which the food product can be dispensed by a consumer. Afterwards, there is no way for the consumer to completely reseal the bag. Often, the consumer will simply roll the open end of the bag over itself (and may clip the end) to reduce airflow into the bag. Depending on how quickly the consumer's household consumes the food product though, this may not be sufficient to maintain the freshness of the food product until it is fully consumed. Accordingly, it would be desirable to provide a way for consumers to reseal such bags.

SUMMARY OF THE INVENTION

The present invention achieves the above goal through the addition of a resealable seal to a bag that includes multiple non-resealable seals. In particular, a resealable bag comprises a first end and a second end opposite the first end. A first transverse seal seals the first end, while a second transverse seal seals the second end. The second transverse seal is part of a weak seal zone configured to be readily unsealed by a consumer by hand. A third transverse seal is located between the first transverse seal and the second transverse seal, closer to the second transverse seal than the first transverse seal. The third transverse seal is at least partially longitudinally aligned with the second transverse seal. Also, the third transverse seal is configured to be selectively unsealed and resealed by the consumer by hand.

In one embodiment, a fourth transverse seal is located between the first transverse seal and the second transverse seal, closer to the second transverse seal than the first transverse seal. In another embodiment, a fourth transverse seal seals the second end. In either case, the fourth transverse seal is at least partially transversely aligned with the third transverse seal. Also, the fourth transverse seal is part of a strong seal zone configured not to be readily unsealed by the consumer by hand.

By this construction, a resealable bag, defining a storage area for containing a food product and including first and second longitudinally spaced end portions, is provided with a seal assembly at the second end portion for use in selectively accessing the storage area through the second end portion for dispensing of the product from the bag, with the seal assembly including first, second and third distinct, transverse seals, and with the second seal being a resealable seal. Once the resealable bag is initially opened through the second transverse seal, the third transverse seal can be selectively, repeatedly unsealed and resealed by the consumer to access the contents of the bag and then reseal the bag to maintain freshness.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting but merely as a representative basis for teaching one skilled in the art how to construct and employ the present invention. In addition, any specific numerical value listed herein includes a margin of error of +/−5%. Accordingly, a length of 1.00 centimeters includes lengths between 0.95 and 1.05 centimeters. Similarly, a range of 1.00-1.20 centimeters includes lengths between 0.95 and 1.26 centimeters. The term "approximately" increases the margin of error to 10%. For numerical values expressed as percentages, the margin of error refers to the base numerical value. In other words, "approximately 20%" means 18-22% and not 10-30%.

As discussed above, certain food products are commonly packaged in bags, with the bags being sealed during production to help keep the food products fresh. To facilitate the opening of such a bag, the bag can have at least one seal that is relatively weaker so that a consumer can more easily peel open the seal to form a hole through which the food product can be dispensed. Once the seal has been destroyed, there is no way for the consumer to completely reseal the bag, and the resulting airflow into the bag can lead to the food product becoming stale, rancid or otherwise undesirable before being fully consumed. The present invention was developed to address this problem. Specifically, the present invention provides a resealable bag. The bag has a seal at each end, with one of the seals being a relatively weaker seal that is meant to be peeled open by the consumer. A resealable seal is provided adjacent to and aligned with the weaker seal, allowing the consumer to dispense the food product past these seals and then reseal that end of the bag.

Figure 1:
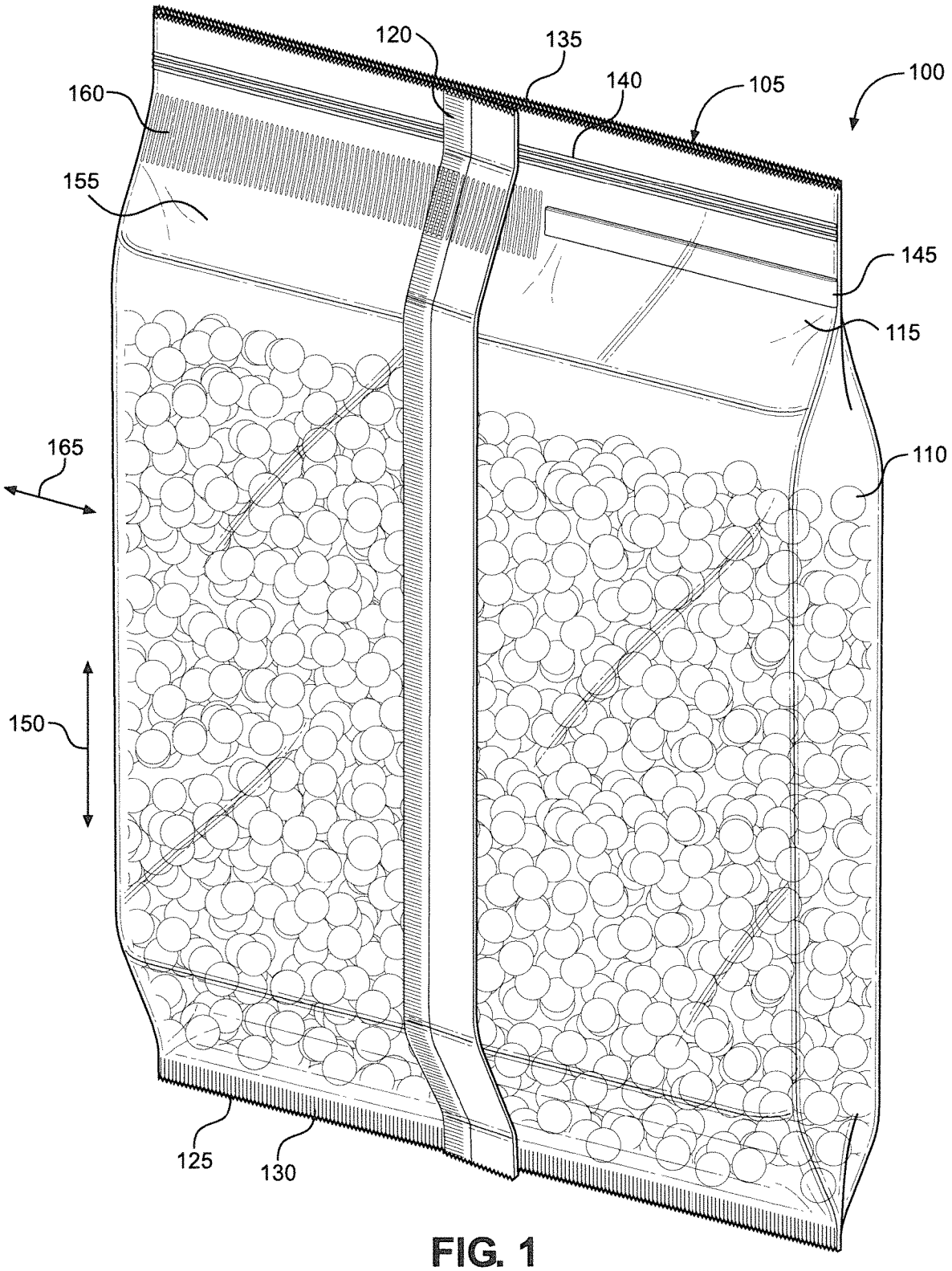
FIG. 1 is perspective view of a packaged food product produced in accordance with a first embodiment of the present invention.

With reference to FIG. 1, a packaged food product 100 is shown. Packaged food product 100 includes a resealable bag 105 and a food product 110 contained within bag 105. Food product 110 is illustrated as an RTE or breakfast cereal. However, bag 105 can be used with a wide range of products, including snacks for pets or crackers.

Bag 105 includes a sidewall 115, formed by bringing together and then joining two edges of a sheet of material using a longitudinal seal 120, which can take various forms, such as a fin seal or a lap seal. Bag 105 also has a first end 125, preferably permanently sealed by a first transverse seal 130, and a second end 135, sealed by a second transverse seal 140. The intent is for second end 135 and second transverse seal 140 to be those that are opened by a consumer. Since bag 105 is typically held vertically when opened, second end 135 and second transverse seal 140 essentially function as a top end and seal at or adjacent an upper terminal edge of bag 105, while first end 125 and first transverse seal 130 function as a bottom end and seal.

To facilitate the opening of bag 105, second transverse seal 140 is configured to establish or be part of a weak seal zone of bag 105. That is, second transverse seal 140 is configured to be strong enough to stay intact through further packaging steps, as well as transportation and storage, but a least a portion of second transverse seal 140 is weak enough to be easily pulled apart and permanently unsealed by a consumer by hand, i.e., to be readily unsealed by the consumer by hand. In a preferred embodiment, this corresponds to an opening force of approximately 2.5 pound-force ($lb_f$) (measured along the width/length of the seal). In contrast, longitudinal seal 120 and first transverse seal 130 are configured to establish or be part of strong or generally permanent seal zones. That is, seals 120 and 130 are configured not to be readily unsealed by the consumer by hand. This corresponds to an opening force of greater than 5 $lb_f$ and preferably greater than 6 $lb_f$. For purposes of the present invention, "by hand" means using one or both hands without any additional tools.

Bag 105 further includes a third transverse seal 145 located between first transverse seal 130 and second transverse seal 140. More specifically, third transverse seal 145 is located closer to second transverse seal 140 than first transverse seal 130 and is at least partially longitudinally aligned with second transverse seal 140, longitudinally spaced from but directly adjacent a portion of second transverse seal 140. At this point, it should be understood that by "longitudinal seal", it is meant that the seal is longer or elongated in the longitudinal direction (denoted 150). In addition, by "longitudinally aligned", it is meant that a straight line can be drawn through both of seals 140 and 145 in the longitudinal direction (denoted 150). Since at least a portion of second transverse seal 140 is not longitudinally aligned with third transverse seal 145 in the embodiment illustrated, seals 140 and 145 are only partially longitudinally aligned.

The arrangement of seals 140 and 145 provides a pathway for food product 110 to exit bag 105. In particular, sidewall 115 defines a storage area 155 in which food product 110 is retained. Storage area 155 is further defined by the transverse seals of bag 105. As a result, to exit storage area 155, food product 110 must pass by at least one of the transverse seals. Since seals 140 and 145 are at least partially longitudinally aligned, food product 110 can pass by third transverse seal 145 and then second transverse seal 140 to exit storage area 155 and bag 105.

Third transverse seal 145 is configured to be selectively unsealed and resealed by the consumer by hand (i.e., without any additional tools, such as adhesives or heat). In the embodiment illustrated, third transverse seal 145 is a zipper seal. However, other types of resealable seals can be used. A fourth transverse seal 160 is at least partially transversely aligned with third transverse seal 145. Consistent with the definitions provided above, it should be understood that by "transverse seal", it is meant that the seal is longer or elongated in the transverse direction (denoted 150). In addition, by "transversely aligned", it is meant that a straight line can be drawn through both of seals 145 and 160 in the transverse direction (denoted 165). Since at least a portion of fourth transverse seal 160 is not transversely aligned with third transverse seal 145 in the embodiment illustrated, seals 145 and 160 are only partially transversely aligned.

In addition to being transversely aligned, seals 145 and 160 together extend across almost the entire width of bag 105. As a result, food product 110 must pass by one of seals 145 and 160 prior to passing by second transverse seal 140. Like longitudinal seal 120 and first transverse seal 130, fourth transverse seal 160 is configured as a strong seal. That is, fourth transverse seal 160 is configured not to be readily unsealed by the consumer by hand. Accordingly, fourth transverse seal 160 remains intact, or at least relatively intact, so as to still provide a strategically located sealing region when seals 140 and 145 are opened. This means that sealing third transverse seal 145 can effectively reseal bag 105 after second transverse seal 140 has been opened. As compared with a conventional bag, this provides an extended shelf life for food product 110 by reducing or preventing airflow into bag 105.

Figure 2:
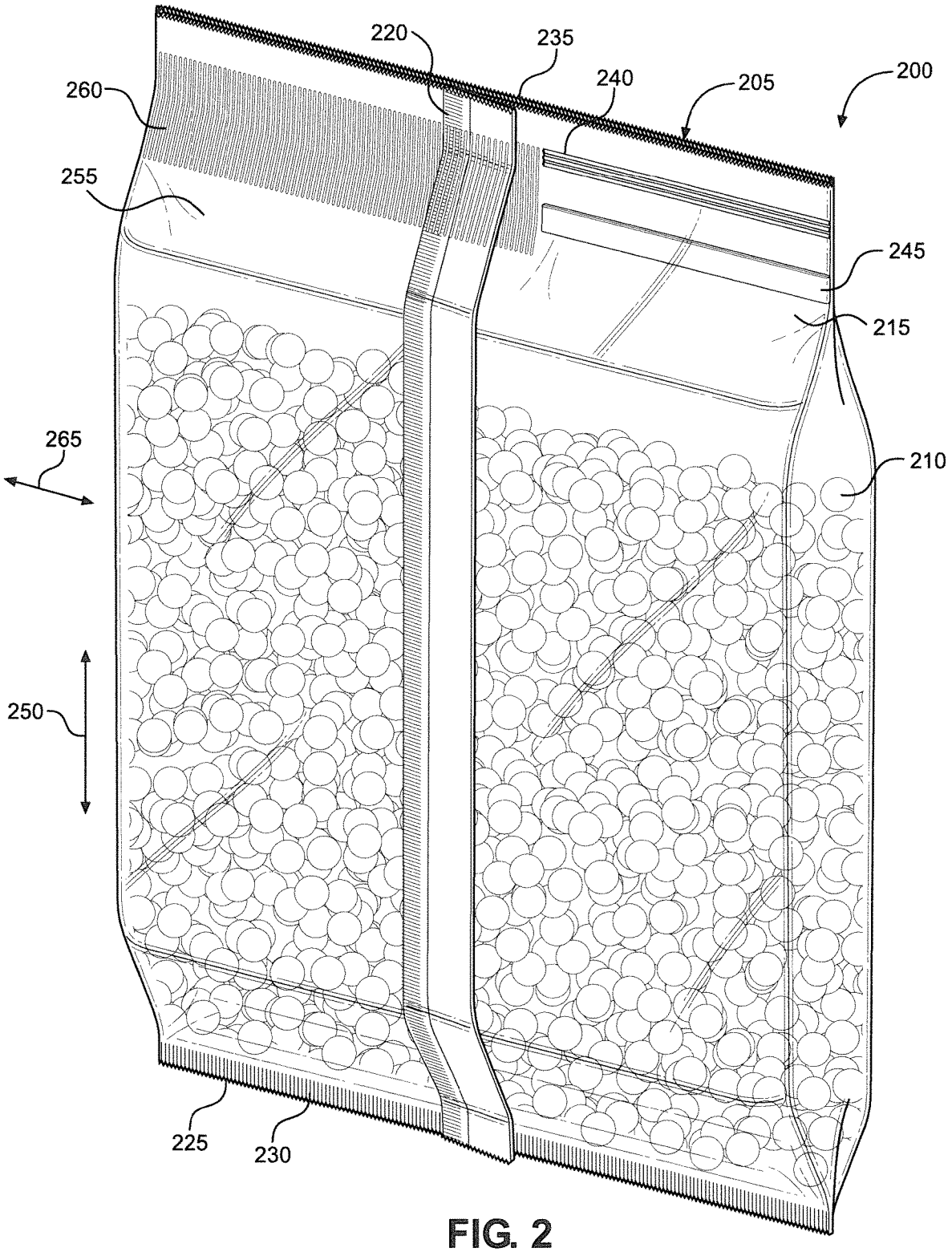
FIG. 2 is a perspective view of a packaged food product produced in accordance with a second embodiment of the present invention.

In the embodiment of FIG. 1, fourth transverse seal 160 is located between first transverse seal 130 and second transverse seal 140, closer to second transverse seal 140 than first transverse seal 130. However, alternative arrangements are possible. For example, FIG. 2 shows a packaged food product 200 including a resealable bag 205 and a food product 210 contained within bag 205. Bag 205 includes a sidewall 215, a longitudinal seal 220, a first end 225, a first transverse seal 230, a second end 235, a second transverse seal 240, a third transverse seal 245, a storage area 255 and a fourth transverse seal 260. For reference, the longitudinal direction is denoted 250, and the transverse direction is denoted 265. Packaged food product 200 is substantially the same as packaged food product 100 except for the arrangement of seals 240 and 260. Essentially, fourth transverse seal 260 has been extended toward second end 235 to replace a portion of second transverse seal 240 (as compared with the embodiment of FIG. 1). As a result, second transverse seal 240 only extends part of the way across bag 205, and seals 240 and 260 together seal second end 235. Despite these changes, the end result is the same. Since the portion of second transverse seal 240 aligned with third transverse seal 245 remains, food product 210 can still be dispensed past seals 240 and 245. Even in the embodiment of FIG. 1, most of food product 110 that is dispensed from bag 105 passes by the portion of second transverse seal 140 that is longitudinally aligned with third transverse seal 145. In fact, it is expected that most consumers will not peel open second transverse seal 140 across its entire width.

Figure 3:
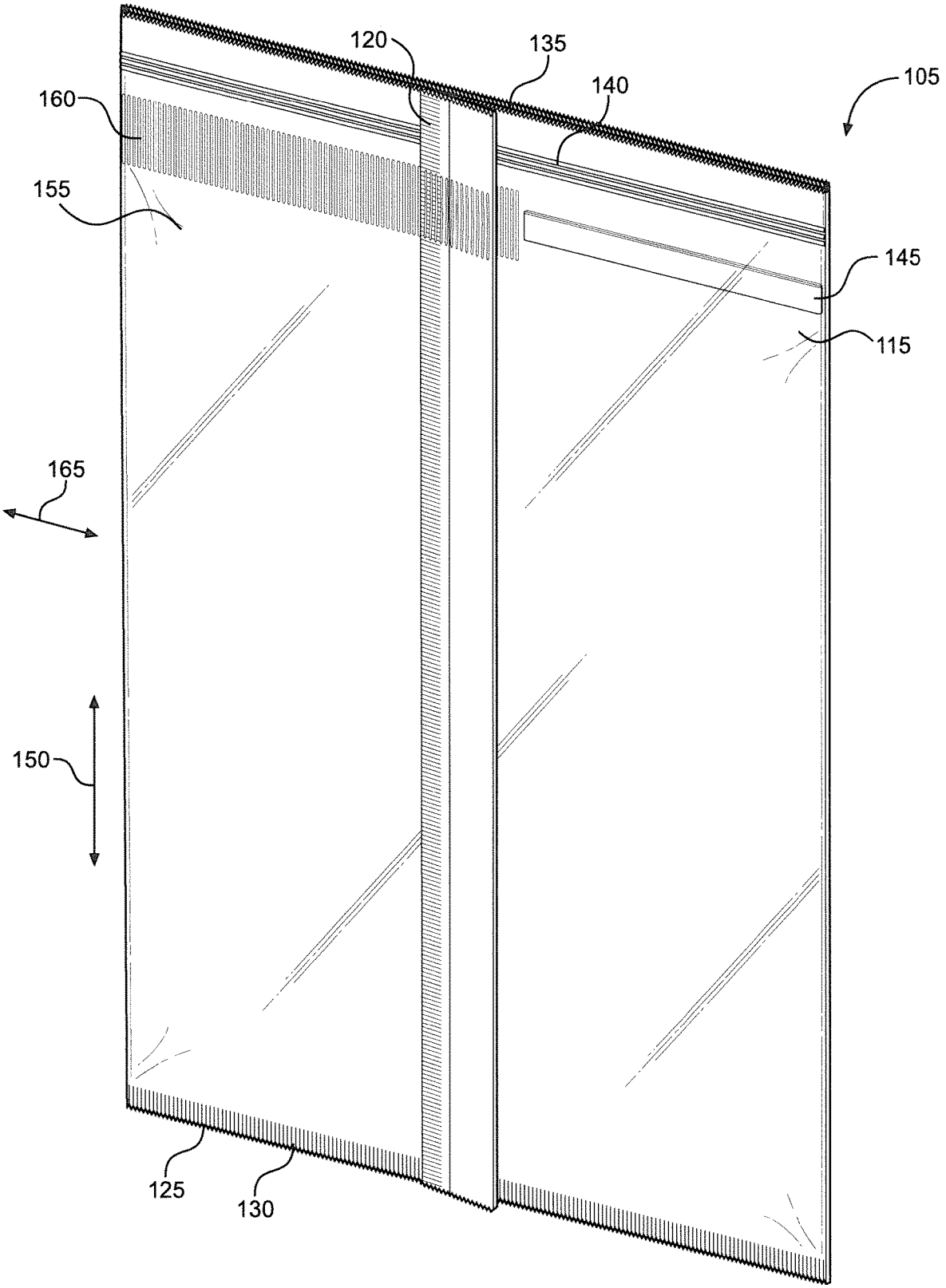
FIG. 3 is a perspective view of a resealable bag of the first embodiment.
Figure 4:
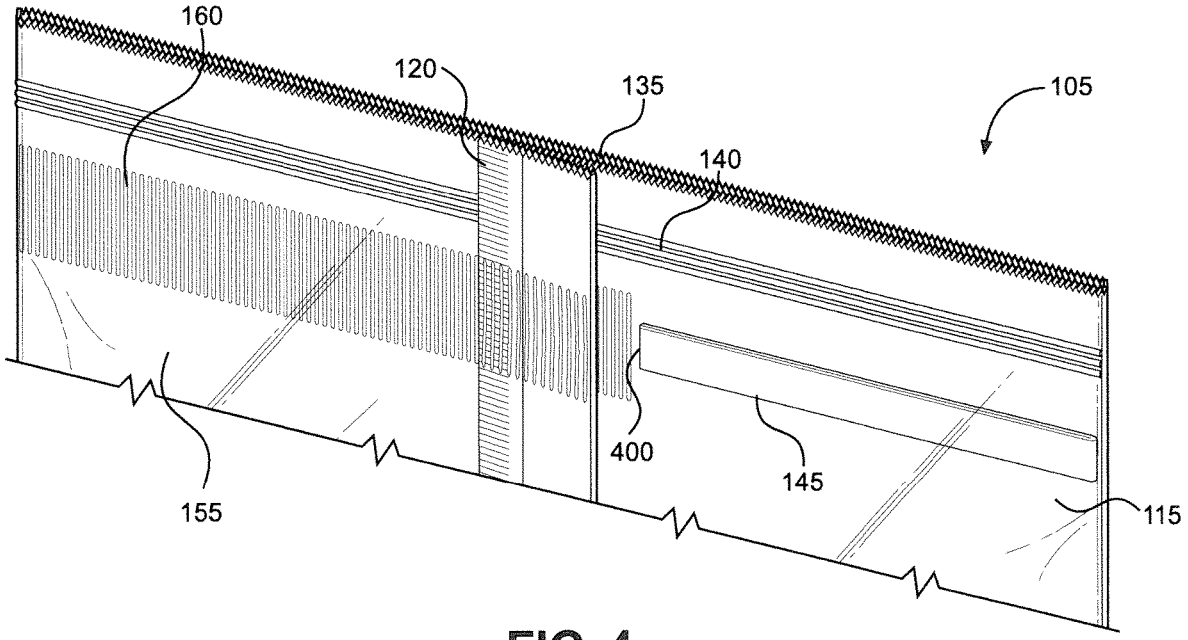
FIG. 4 is a perspective view of an end of the resealable bag.

Turning to FIGS. 3 and 4, bag 105 is shown without food product 110. As shown in these figures, third transverse seal 145 extends less than halfway across bag 105. In general, third transverse seal 145 should extend across approximately 25-75% of the width of bag 105. Preferably, third transverse seal 145 extends across approximately 33-66% of the width of bag 105. Most preferably, third transverse seal 145 extends across approximately 40-60% of the width of bag 105. The length of third transverse seal 145 is limited by the presence of longitudinal seal 120, which third transverse seal 145 cannot cross (although it should be recognized that the position of longitudinal seal 120 can be adjusted in transverse direction 165). Still, it should be recognized that third transverse seal 145 is more expensive than fourth transverse seal 160, and it is unnecessary for third transverse seal 145 to span the entire width of bag 105 since food product 110 can be readily dispensed through an opening smaller than the width of bag 105.

At this point, it should be understood that fourth transverse seal 160, if provided, need not combine with third transverse seal 145 to extend all the way across bag 105 as shown. That is, the existence of fourth transverse seal 160 can be considered to mandate the opening of another region of bag 105, i.e., a transverse bag region or zone not containing fourth transverse seal 160. However, a significant aspect of the invention is the tactical information conveyed to the person opening bag 105 by the mere presence of a strong seal region, such as provided by fourth transverse seal 160. More specifically, if opening the right side (as depicted) of bag 105, a user will need to apply a relatively high opening force to initially break part of second transverse seal 140. Then, the force (lateral peel force, e.g., 1 $lb_f$) required to propagate that opening is lowered. However, when that propagation reaches fourth transverse seal 160, the user will feel a high resistance to further expand the opening in that direction. This resistive force can be referred to as a termination force. This termination force is preferably in the order of 2.5 times the lateral peel force in that direction and, more preferably, over 3 times the lateral peel force, with the minimum termination force being at least 2.5 $lb_f$ (approximately 11.1 N), and preferably at least 3.0 $lb_f$ (approximately 13.3 N). With this in mind, it should be recognized that this feature of limiting propagation and providing tactical feedback could be achieved, by way of example, with just having a relatively short fourth transverse seal 160, say only from the end of third transverse seal 145 to longitudinal seal 120 in the depicted bag version, e.g., fourth transverse seal 160 would extend only in a small center region of bag 105. Of course, this arrangement would enable a side of bag 105 which does not have second transverse seal 140 to be mistakenly opened by a user, thereby losing the advantages associated with the resealing characteristics of second transverse seal 140. In any case, this possibility exists, as does providing dual, transversely extending resealable seals spaced by a short fourth transverse seal. In any case, although some reference has been made to the strength of the various seals, it is really the combined strength of the sealing forces which must be overcome to propagate the opening which is important to this aspect of the invention. Therefore, any given seal need not actually be "stronger" but rather it is the relative arrangement of the seals and the combined strength of the seals in established stronger and weaker seal regions of bag 105 which enables the desired tactical feedback. Therefore, in accordance with the invention, "weaker" in connection with a seal or region means it is easier to both open the bag at that seal region and propagate the opening within that region, as compared to another, stronger seal region of the bag.

As most clearly seen in FIG. 4, there is a small gap 400 shown between seals 145 and 160. This spacing helps prevent the sealing jaw used to form fourth transverse seal 160 from damaging third transverse seal 145 during production of bag 105. However, it is possible, and preferable, to minimize or even avoid this gap. In general, if gap 400 is present, gap 400 should be less than approximately 5 millimeters (mm). Preferably, gap 400 is less than approximately 3 mm. Most preferably, gap 400 is approximately 0-2 mm. However, in other embodiments, no gap can be provided, such as by having seals 145 and 160 overlap, even perhaps with the crushing of that end of seal 145 during the formation of seal 160.

Figure 5:
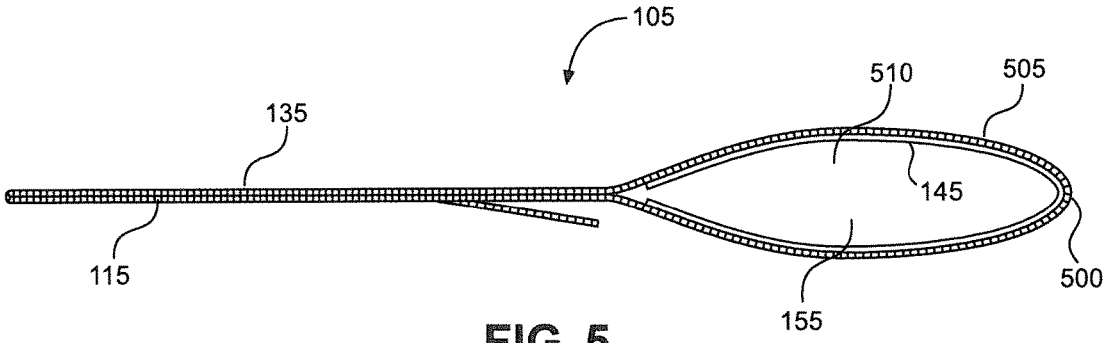
FIG. 5 is a top view of the resealable bag.

With reference now to FIG. 5, a top view of bag 105 is provided, with part of second seal 140 and all of third transverse seal 145 shown unsealed. Because third transverse seal 145 is looped and folded back on itself during production of bag 105 to wrap third transverse seal 145 inside a right, rounded edge 500 of bag 105, third transverse seal 145 is inherently biased to spring apart at edge 500. This advantageously helps bag 105 maintain an open state when third transverse seal 145 is unsealed. Specifically, a spout 505 is formed by sidewall 115, defining an opening or passageway 510. Preferably, third transverse seal 145 is not sealed during production of bag 105. Instead, second transverse seal 140 serves to seal second end 135 of bag 105, obviating the necessity of initially sealing third transverse seal 145.

Figure 6:
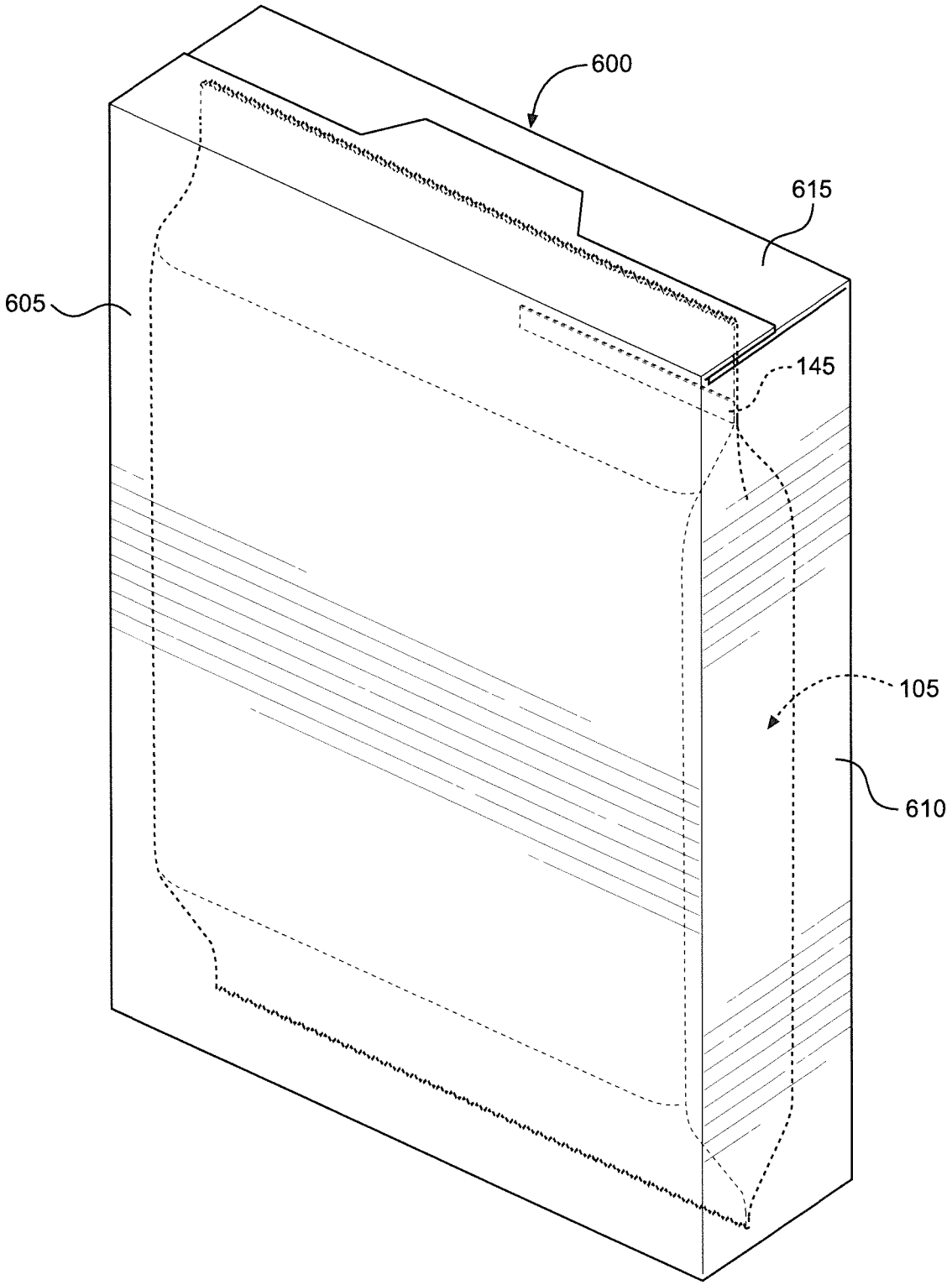
FIG. 6 is a perspective view of the packaged food product of the first embodiment further comprising a box.

Turning to FIG. 6, packaged food product 100 is shown further comprising a box 600. Bag 105 and food product 110 are located within box 600 such that they are not visible. The inclusion of box 600 is optional. When used, box 600 helps protect food product 110 during transportation and storage and provides convenient surfaces for marketing and nutritional information. In particular, box 600 includes a front wall 605, a rear wall (not visible), two sidewalls (one of which is visible and labeled 610), a top wall 615 and a bottom wall (not visible).

Although there are different ways to produce packaged product 100, packaged food product 100 is preferably produced using a vertical form-fill-seal process. A horizontal form-fill seal process is certainly a possibility. Certainly less preferable, but certainly possible, a bag could be formed by folding sheet material onto itself, with the fold line obviating the need for making the first transverse seal 130 as the fold line would inherently establish a first transverse seal, while side edge seals would be produced instead of longitudinal seal 120. Regardless, a resealable bag, defining a storage area for containing a food product and including first and second longitudinally spaced end portions, would still be provided with a seal assembly at the second end portion for use in selectively accessing the storage area through the second end portion for dispensing of the product from the bag, with the seal assembly including at least two distinct, transverse seals, and with one of the two distinct seals being a resealable seal. In the detailed embodiment, it should be noted that third transverse seal 145 is preferably attached to the material used to form bag 105 prior to the other forming steps, i.e., prior to formation of longitudinal seal 120 or any of the other transverse seals.

Based on the above, it should be readily apparent that the present invention provides a way for consumers to reseal a bag after a portion of a food product contained within the bag has been dispensed. While certain preferred embodiments of the present invention have been set forth, it should be understood that various changes or modifications could be made without departing from the spirit of the present invention. In general, the invention is only intended to be limited by the scope of the following claims.

The invention claimed is:

1. A resealable bag comprising:

a first end having a first transverse seal;

a second end which is longitudinally spaced from and opposite the first end;

a second transverse seal sealing the second end, wherein the second transverse seal is part of a weak seal zone configured to be readily unsealed by a consumer by hand;

a third transverse seal between the first transverse seal and the second transverse seal, wherein the third transverse seal is located closer to the second transverse seal than the first transverse seal, the third transverse seal is at least partially longitudinally aligned with the second transverse seal wherein, once the resealable bag is initially opened through the second transverse seal, the third transverse seal can be selectively, repeatedly unsealed and resealed by the consumer by hand; and a fourth transverse seal between the first transverse seal and the second transverse seal, wherein the fourth transverse seal is located closer to the second transverse seal than the first transverse seal, the fourth transverse seal is at least partially transversely aligned with the third transverse seal and the fourth transverse seal has a longitudinal dimension greater than a longitudinal dimension of the third transverse seal and the fourth transverse seal is part of a strong seal zone having an associated minimum termination force, which would be needed to break the strong seal zone, of approximately 2.5-3.0 times a lateral peel force needed to propagate an opening of the second transverse seal toward the fourth transverse seal.

2. The resealable bag of claim 1, wherein the fourth transverse seal is part of the strong seal zone which is configured to not be readily unsealed by the consumer by hand.

3. The resealable bag of claim 2, wherein the associated minimum termination force is 2.5 times the lateral peel force.

4. The resealable bag of claim 3, wherein the associated minimum termination force is approximately 2.5 $lb_f$.

5. A packaged food product comprising:

the resealable bag of claim 3; and a food product contained within the resealable bag.

6. The packaged food product of claim 5, wherein the food product is a ready-to-eat cereal, a pet food or crackers.

7. The packaged food product of claim 5, further comprising a box, wherein the resealable bag is located within the box.

8. The resealable bag of claim 4, wherein the associated minimum termination force is approximately 3.0 $lb_f$.

9. The resealable bag of claim 1, wherein the associated minimum termination force, which would be needed to break the strong seal zone, is approximately 2.5 $lb_f$.

10. The resealable bag of claim 1, wherein the third transverse seal is a zipper seal.

11. The resealable bag of claim 10, wherein the zipper seal includes a first portion and a second portion configured to selectively mechanically mate with one another to seal the zipper seal.

12. The resealable bag of claim 1, wherein the second transverse seal extends across at least 25% of a width of the resealable bag.

13. The resealable bag of claim 12, wherein the third transverse seal extends across 25-75% of the width of the resealable bag.

14. The resealable bag of claim 13, wherein both of the first and second transverse seals extend across 100% of the width of the resealable bag.

15. The resealable bag of claim 1, wherein the third transverse seal is constituted by a single piece in the form of a loop at an edge portion of the resealable bag so as to be bent, and biased to unbend, thereby tending to establish a spout for the resealable bag when third transverse seal is unsealed.

16. The resealable bag of claim 1, wherein the first transverse seal establishes a strong seal region configured not to be readily unsealed by the consumer by hand and the weak seal zone of the second transverse seal extends across 100% of the width of the sealable bag.

17. The resealable bag of claim 1, further comprising a longitudinal seal extending from the first end to the second end.

18. A packaged food product comprising:

the resealable bag of claim 1; and a food product contained within the resealable bag.

19. A packaged food product comprising:

a resealable bag defining a storage area for containing a food product, said resealable bag including first and second longitudinally spaced end portions, with the second end portion including a terminal edge and a seal assembly for use in selectively accessing the storage area through the second end portion for dispensing of the product from the bag, said seal assembly including first, second and third distinct, transverse seals, with the second seal being a selectively resealable seal, wherein:

the first transverse seal is located closer to the terminal edge than the second transverse seal and includes a first seal portion which is part of a weak seal zone of the resealable bag configured to be readily, permanently unsealed by a consumer by hand;

both of the second and third transverse seals are spaced farther from the terminal edge than the first transverse seal;

the second and third transverse seals combine to extend all the way across the resealable bag; and the third transverse seal is part of a strong seal zone, wherein the strong seal zone has an associated minimum termination force, which would be needed to break the strong seal zone, of approximately 2.5-3 times a lateral peel force needed to propagate an opening in the first seal portion toward the strong seal zone.

20. The packaged food product of claim 19, wherein at least two of the first, second and third transverse seals extend only partially across the second end portion of the resealable bag.

21. The packaged food product of claim 20, wherein the first transverse seal extends across 100% of the width of the resealable bag, while the second and third transverse seals combine to extend all the way across the resealable bag.

22. The packaged food product of claim 19, wherein the second and third transverse seals combine to extend all the way across the resealable bag.

23. The packaged food product of claim 19, wherein the associated minimum termination force is approximately 2.5 $lb_f$.

24. The packaged food product of claim 19, wherein the associated minimum termination force is approximately 3.0 $lb_f$.

25. A method of producing a resealable bag, the method comprising:

sealing a first end of the resealable bag with a first transverse seal;

sealing a second end of the resealable bag with a second transverse seal, wherein the second end is longitudinally spaced from and opposite the first end, and the second transverse seal is part of a weak seal zone of the resealable bag configured to be readily unsealed by a consumer by hand;

forming a third transverse seal between the first transverse seal and the second transverse seal, wherein the third transverse seal is located closer to the second transverse seal than the first transverse seal, the third transverse seal is at least partially longitudinally aligned with the second transverse seal, and the third transverse seal is configured to be selectively unsealed and resealed by the consumer by hand, once the resealable bag is initially opened through the second transverse seal; and forming a fourth transverse seal between the first transverse seal and the second transverse seal, wherein the fourth transverse seal is located closer to the second transverse seal than the first transverse seal, the fourth transverse seal is at least partially transversely aligned with the third transverse seal, the fourth transverse seal has a longitudinal dimension greater than a longitudinal dimension of the third transverse seal and the fourth transverse seal is part of a strong seal zone having an associated minimum termination force, which would be needed to break the strong seal zone, of approximately 2.5-3.0 times a lateral peel force needed to propagate an opening of the second transverse seal toward the fourth transverse seal.

26. The method of claim 25, wherein forming the third transverse seal includes attaching a zipper seal to the resealable bag.

27. The method of claim 25, further comprising:

attaching the third transverse seal to material of the resealable bag; and after attaching the third transverse seal, creating a longitudinal seal for the resealable bag using a vertical a vertical form-fill-seal process.

28. The method of claim 25, wherein the second transverse seal extends across 100% of a width of the resealable bag, and the third transverse seal extends across 25-75% of the width of the resealable bag.

29. The method of claim 25, wherein the strong seal zone of the resealable bag is configured not to be readily unsealed by the consumer by hand.

30. The method of claim 29, further comprising forming the strong seal zone such that an associated minimum termination force, which would be needed to break the strong seal zone, is approximately 2.5 $lb_f$.

31. The method of claim 29, further comprising forming the associated minimum termination force, which would be needed to break the strong seal zone, of to be approximately 2.5 times the lateral peel force.

32. A method of producing a packaged food product, the method comprising:

performing the method of claim 25;

depositing a food product within the resealable bag;

sealing the resealable bag; and depositing the resealable bag within a box.

* * * * *